US008858366B2

(12) United States Patent
Liu

(10) Patent No.: US 8,858,366 B2
(45) Date of Patent: Oct. 14, 2014

(54) GOLF BALL HAVING LAYERS WITH SPECIFIED MODULI AND HARDNESSES

(75) Inventor: Chen-Tai Liu, Yun-lin Hsien (TW)

(73) Assignee: NIKE, Inc., Beaverton, OR (US)

( * ) Notice: Subject to any disclaimer, the term of this patent is extended or adjusted under 35 U.S.C. 154(b) by 1082 days.

(21) Appl. No.: 12/860,785

(22) Filed: Aug. 20, 2010

(65) Prior Publication Data

US 2012/0046128 A1 Feb. 23, 2012

(51) Int. Cl.

*A63B 37/04* (2006.01)
*A63B 37/02* (2006.01)
*A63B 37/00* (2006.01)

(52) U.S. Cl.

CPC ..... *A63B 37/0003* (2013.01); *A63B 37/0045* (2013.01); *A63B 37/0078* (2013.01); *A63B 37/0064* (2013.01); *A63B 37/0034* (2013.01); *A63B 37/0049* (2013.01); *A63B 37/0086* (2013.01); *A63B 37/0046* (2013.01); *A63B 37/0087* (2013.01); *A63B 37/0033* (2013.01); *A63B 37/0076* (2013.01); *A63B 37/0092* (2013.01); *A63B 37/0043* (2013.01); *A63B 37/0062* (2013.01); *A63B 37/0037* (2013.01); *A63B 37/0061* (2013.01); *A63B 37/0069* (2013.01); *A63B 37/0065* (2013.01); *A63B 37/0031* (2013.01); *A63B 37/0059* (2013.01)

USPC ..... 473/376; 473/377

(58) Field of Classification Search

USPC ..... 473/324–378

See application file for complete search history.

(56) References Cited

U.S. PATENT DOCUMENTS

| | | | | |
|---|---|---|---|---|
| 5,120,791 | A | 6/1992 | Sullivan | |
| 5,439,227 | A * | 8/1995 | Egashira et al. | 473/373 |
| 5,688,191 | A * | 11/1997 | Cavallaro et al. | 473/373 |
| 5,772,530 | A * | 6/1998 | Kato | 473/363 |
| 5,779,562 | A * | 7/1998 | Melvin et al. | 473/373 |
| 5,820,486 | A * | 10/1998 | Tanaka et al. | 473/374 |
| 5,873,796 | A * | 2/1999 | Cavallaro et al. | 473/365 |
| 5,971,870 | A * | 10/1999 | Sullivan et al. | 473/373 |
| 5,980,396 | A * | 11/1999 | Moriyama et al. | 473/376 |
| 6,045,460 | A * | 4/2000 | Hayashi et al. | 473/376 |
| 6,057,403 | A * | 5/2000 | Sullivan et al. | 525/221 |
| 6,117,025 | A * | 9/2000 | Sullivan | 473/373 |
| 6,152,834 | A * | 11/2000 | Sullivan | 473/365 |
| 6,180,722 | B1 * | 1/2001 | Dalton et al. | 525/193 |
| 6,206,791 | B1 * | 3/2001 | Moriyama et al. | 473/376 |

(Continued)

FOREIGN PATENT DOCUMENTS

| | | |
|---|---|---|
| CA | 2748863 C | 7/2013 |
| EP | 2420299 | 7/2013 |

(Continued)

OTHER PUBLICATIONS

European Search Report for European Patent Application No. EP11178040.9, mailed on Jan. 17, 2012.

(Continued)

*Primary Examiner* — Alvin Hunter

(74) *Attorney, Agent, or Firm* — Plumsea Law Group, LLC

(57) ABSTRACT

A golf ball includes four layers. The first, third, and fourth layers are made from thermoplastic materials and the second is made of a thermoset material. The third layer is the hardest and is at least 10 Shore D harder than the fourth layer. The flexural modulus of the third layer is greater than that of the first layer, and the flexural modulus of the first layer is greater than that of the fourth layer.

14 Claims, 1 Drawing Sheet

(56) References Cited

U.S. PATENT DOCUMENTS

| | | | | |
|---|---|---|---|---|
| 6,213,895 | B1 * | 4/2001 | Sullivan et al. | 473/374 |
| 6,220,972 | B1 * | 4/2001 | Sullivan et al. | 473/374 |
| 6,231,461 | B1 * | 5/2001 | Moriyama et al. | 473/376 |
| 6,248,027 | B1 * | 6/2001 | Hayashi et al. | 473/371 |
| 6,486,261 | B1 * | 11/2002 | Wu et al. | 525/332.6 |
| 6,547,677 | B2 * | 4/2003 | Sullivan et al. | 473/376 |
| 6,588,076 | B1 | 7/2003 | Choate | |
| 6,632,147 | B2 * | 10/2003 | Cavallaro et al. | 473/374 |
| 6,783,468 | B2 * | 8/2004 | Sullivan et al. | 473/374 |
| 6,793,593 | B2 * | 9/2004 | Binette et al. | 473/374 |
| 6,855,076 | B2 | 2/2005 | Matroni et al. | |
| 6,887,168 | B2 | 5/2005 | Hayashi et al. | |
| 6,921,346 | B2 | 7/2005 | Hayashi et al. | |
| 6,995,191 | B2 | 2/2006 | Sullivan et al. | |
| 7,086,970 | B2 | 8/2006 | Hayashi et al. | |
| 7,125,345 | B2 | 10/2006 | Sullivan et al. | |
| 7,153,838 | B2 | 12/2006 | Andersson et al. | |
| 7,270,610 | B1 | 9/2007 | Sullivan et al. | |
| 7,300,364 | B2 | 11/2007 | Boehm et al. | |
| 7,351,165 | B2 | 4/2008 | Sullivan et al. | |
| 7,375,153 | B2 | 5/2008 | Goguen et al. | |
| 7,513,838 | B2 | 4/2009 | Sullivan et al. | |
| 7,528,196 | B2 | 5/2009 | Kim et al. | |
| 7,534,174 | B2 | 5/2009 | Sullivan et al. | |
| 7,713,144 | B2 | 5/2010 | Kennedy, III et al. | |
| 2002/0155906 | A1 | 10/2002 | Sullivan | |
| 2003/0100384 | A1 | 5/2003 | Nesbitt | |
| 2006/0281585 | A1 | 12/2006 | Jordan | |
| 2006/0281586 | A1 | 12/2006 | Sullivan | |
| 2007/0207880 | A1 | 9/2007 | Sullivan et al. | |
| 2007/0270239 | A1 | 11/2007 | Sullivan et al. | |
| 2009/0170634 | A1 | 7/2009 | Loper et al. | |
| 2009/0325730 | A1 | 12/2009 | Sullivan | |
| 2010/0133186 | A1 | 6/2010 | Liu et al. | |
| 2010/0160079 | A1 | 6/2010 | Kim et al. | |
| 2010/0179001 | A1 | 7/2010 | Cheng et al. | |
| 2010/0261553 | A1 | 10/2010 | Hebert et al. | |

FOREIGN PATENT DOCUMENTS

| | | |
|---|---|---|
| JP | H053931 | 1/1993 |
| JP | H05286443 | 11/1993 |
| JP | H06292740 | 10/1994 |
| JP | H10329327 | 12/1998 |
| JP | 2006223875 | 8/2006 |
| JP | 2008264555 | 11/2008 |
| JP | 2009-160407 | 7/2009 |
| KR | 1019980064378 | 10/1998 |
| KR | 1019980081817 | 11/1998 |
| KR | 100995019 | 11/2010 |
| TW | M365191 | 9/2009 |

OTHER PUBLICATIONS

Notice of Decision for Patent for Korean Patent Application No. 10-2011-0082934, mailed on Mar. 26, 2012.

Certified English-language Translation of Korean Prior Art Search Report in Korean Application No. 10-2011-0082934 dated Nov. 21, 2011.

Office Action mailed Sep. 26, 2013 for Chinese Invention Patent Application No. 201110240068.3 and the English translation thereof.

Office Action mailed Oct. 21, 2013 for Taiwan Patent Application No. 100128539 and the English translation thereof.

Response to Office Action for Taiwan Patent Application No. 100128539 as submitted on Apr. 14, 2014 and the English translation thereof.

Response to Office Action for Chinese Invention Patent Application No. 201110240068.3 as submitted on Apr. 11, 2014 and the English translation thereof.

Office Action for Japanese Patent Application No. 2011-176519, mailed Mar. 11, 2014 and the English translation thereof.

* cited by examiner

GOLF BALL HAVING LAYERS WITH SPECIFIED MODULI AND HARDNESSES

FIELD

The present disclosure relates generally to a multi-layer golf ball. More specifically, the present disclosure relates to a ball that has four layers, each having its own hardness and flexural modulus properties.

BACKGROUND

Golfers habitually look for golf balls that have a combination of features based on his or her preferences and/or skill level. A golf ball designer often attempts to balance the preferences of a variety of golfers to provide high satisfaction from golfers using the ball. Frequently, a designer will design a ball having a plurality of layers, with each layer helping to provide a desirable quality.

For example, the compression of a golf ball is related to a golfer's performance. For higher the golfer's club head speeds, higher golf ball compression is often desirable. Matching a golfer's compression and club head speed can optimize the golfer's driving distance.

In other examples, the material from which the outer cover is made can be important. Different materials have different hardnesses and resiliencies. These differences affect the way the golf ball feels to the golfer when the ball is hit.

However, a designer also considers the combined effect of the layers when selecting materials for a ball. The layers of a ball often all deform when a ball is hit, and all the layers combine to affect the flight path and distance of a ball.

Many of the materials used in golf balls include thermoplastic materials. When a thermoplastic material is considered, it is often desirable to select such a material based on its flexural modulus, or, generally, its tendency to bend when under load.

In addition, materials commonly used in golf balls vary in hardness. Some golf balls may include a harder material as the outermost material to increase durability, for example.

Accordingly, it is desirable in some cases to design a golf ball based on the desired flexural modulus and desired hardness of each layer. The combined ball can then be used for many golfers to provide a good balance between the layers to provide an appropriate feel, spin control, and distance.

SUMMARY

A ball is provided so that the ball responds and feels differently when encountered in a first instance than when encountered in a second instance. This is accomplished by providing a layered article, where each of the layers has specific material and mechanical properties relative to the other layers. In a golf ball, the ball is provided to have a first feel and response (distance and accuracy) when hit with a driver and a second feel and response (feel and spinnability) when hit with an iron or wedge. For example, the golf ball may be provided with various thermoplastic and thermoset layers. The flexural modulus of each thermoplastic layer is chosen so that the highest flexural modulus is positioned proximate the surface, though the surface layer has a relatively low flexural modulus. Also, the core, whether single or multi-layer, has a coefficient of restitution (COR) higher than that of the ball as a whole.

In one embodiment, a ball is provided. The golf ball may include a first layer, which may be an inner core layer. The first layer may have a first flexural modulus. A second layer may be an outer core layer and may be radially outward of the first layer. A third layer may be an inner cover layer. The third layer may be radially outward of the second layer and may have a second flexural modulus. A fourth layer may be an outer cover layer. The fourth layer may be radially outward of the third layer and may have a third flexural modulus. The second flexural modulus may be greater than the first flexural modulus. The first flexural modulus may be greater than the third flexural modulus.

The second flexural modulus may be at least three times the first flexural modulus. The first layer may have a first coefficient of restitution and the ball may have a second coefficient of restitution and the first coefficient of restitution may be greater than the second coefficient of restitution. A mantle layer may be positioned between the first layer and the fourth layer.

In another embodiment, a golf ball is provided. The golf ball may include a first layer, which may be an inner core layer. The first layer may have a first hardness. A second layer may be an outer core layer and may be radially outward of the first layer. The second layer may have a second hardness. A third layer may be an inner cover layer. The third layer may be radially outward of the second layer and may have a third hardness. A fourth layer may be an outer cover layer. The fourth layer may be radially outward of the third layer and may have a fourth hardness. The third hardness may be greater than the first hardness. The third hardness may be greater than the second hardness. The third hardness may be greater than the fourth hardness by at least 10 Shore D.

The first layer may have a first coefficient of restitution and the ball may have a second coefficient of restitution and the first coefficient of restitution may be greater than the second coefficient of restitution. A mantle layer may be positioned between the first layer and the fourth layer.

In another embodiment, a layered article is provided. The layered article may include a first layer, which may be an inner core layer. The first layer may have a first flexural modulus and a first hardness. A second layer may be an outer core layer and may be radially outward of the first layer. The second layer may have a second hardness. A third layer may be an inner cover layer. The third layer may be radially outward of the second layer and may have a second flexural modulus and a third hardness. A fourth layer may be an outer cover layer. The fourth layer may be radially outward of the third layer and may have a third flexural modulus and a fourth hardness. The second flexural modulus may be greater than the first flexural modulus. The first flexural modulus may be greater than the third flexural modulus. The third hardness may be greater than the first hardness. The third hardness may be greater than the second hardness. The third hardness may be greater than the fourth hardness by at least 10 Shore D units.

The second flexural modulus may be at least three times the first flexural modulus. The first layer may have a first coefficient of restitution and the ball may have a second coefficient of restitution and the first coefficient of restitution may be greater than the second coefficient of restitution. A mantle layer may be positioned between the first layer and the fourth layer.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
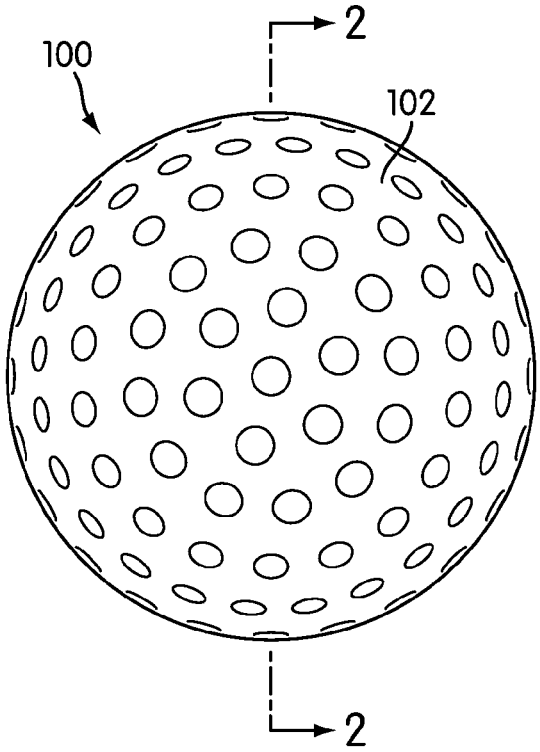
FIG. 1 is a side view of a golf ball according to the present disclosure.
Figure 2:
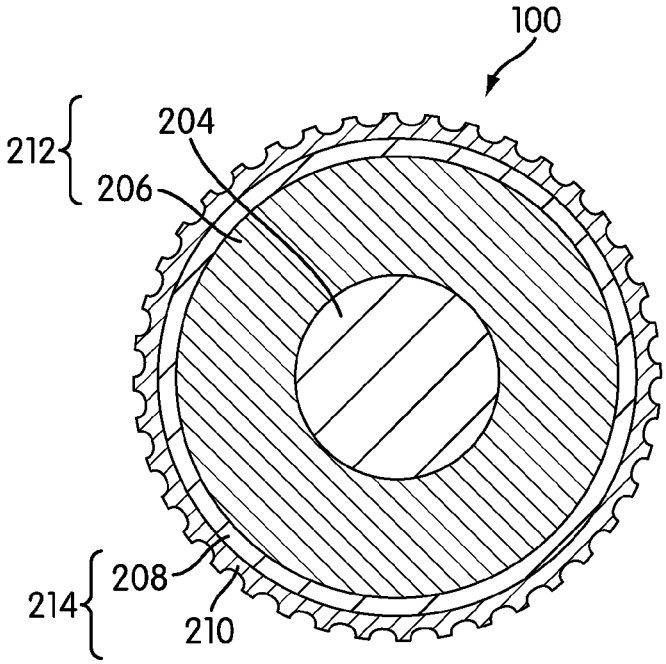
FIG. 2 is a cross sectional view of the golf ball of FIG. 1 taken along line 2-2.

FIG. 1 is a side view of a ball 100 that may be used in accordance with the technology disclosed herein. Although the embodiments discussed herein are limited to golf balls, the invention is not intended to be so limited. The technology described herein may be applicable to any layered article, particularly a projectile, ball, recreational device, or component thereof. Specific formulations are disclosed herein as being desirable. However, other features and formulations may also be used in conjunction with the presently disclosed embodiments. In particular, U.S. patent application Ser. No. 12/627,992 discloses alternative formulations and other descriptions and is incorporated herein by reference. FIGS. 1 and 2 show a generic dimple pattern applied to outer surface 102 of ball 100. While the dimple pattern on ball 100 may affect the flight path of ball 100, no specific dimple pattern is critical to the use of the disclosed embodiments. A designer may select from any appropriate dimple pattern to be applied to ball 100.

FIG. 2 is a cross-sectional view of ball 100 taken along line 2-2 of FIG. 1. As shown in FIG. 2, ball 100 may have four layers. First layer 204 may be an inner core layer. Second layer 206 may be an outer core layer and may be positioned radially outwardly of first layer 204. Third layer 208 may be an inner cover layer and may be positioned radially outwardly of second layer 206. Fourth layer 210 may be an outer cover layer and may be positioned radially outwardly of third layer 208. First or inner core layer 204 and second or outer core layer 206 may together be considered and referred to core 212. Third or inner cover layer 208 and fourth or outer cover layer 210 may together be considered and referred to as cover 214. Any layer may surround or substantially surround any layers disposed radially inward of that layer. For example, second layer 206 may surround or substantially surround first layer 204.

In the present disclosure and drawings, ball 100 has been described and illustrated as having four layers. In some embodiments, an additional layer may be added. For example, in some embodiments, a mantle layer may be added between core 212 and cover 214. In other embodiments, an intermediate cover layer may be inserted between inner cover 208 and outer cover 210. In other embodiments, an intermediate core layer may be inserted between inner core 204 and outer core 206.

The layers of ball 100 may be made of any material known in the art. First layer 204 may be made primarily or entirely of a first thermoplastic material. Third layer 208 may be made primarily or entirely of a second thermoplastic material. Fourth layer 210 may be made primarily or entirely of a third thermoplastic material. Each of first thermoplastic material, second thermoplastic material, and third thermoplastic material may be selected from among various conventional thermoplastic materials. More specifically, each of first thermoplastic material, second thermoplastic material, and third thermoplastic material may be selected from among the following materials: an ionomer resin, a highly neutralized acid polymer composition, a polyamide resin, a polyester resin, a polyurethane resin, and a combination of two or more of these materials. Examples of ionomer resins that may be desirable for use with the present embodiments include SURLYN®, commercially available from E.I. DuPont de Nemours and Company, and IOTEK®, commercially available from Exxon Corporation. Examples of highly neutralized acid polymer compositions may include HPF resins, such as HPF 1000, HPF 2000, AD 1035 and AD 1040, commercially available from E.I. DuPont de Nemours and Company. Each of first thermoplastic material, second thermoplastic material, and third thermoplastic material may be selected from the same or different types of thermoplastic materials. In some embodiments, second thermoplastic material may include a non-ionomeric material and third thermoplastic material may include a non-ionomeric material. In some embodiments, for example, first thermoplastic material may include a highly neutralized polymer composition, second thermoplastic material may include a polyurethane resin, and third thermoplastic material may include a polyurethane resin. If second thermoplastic material and third material include the same type of thermoplastic material, good adhesion between third layer 208 and fourth layer 210 may be promoted.

Second layer 206 may be made primarily or entirely of a thermoset material. The thermoset material may include a rubber compound. If the thermoset material is a rubber compound, a base rubber may be used. The base rubber may include at least one of 1,4-cis-polybutadiene, polyisoprene, styrene-butadiene copolymers, natural rubber, and a combination of two or more of these materials. In some embodiments, 1,4-cis-polybutadiene may be used as the base rubber alone and may provide a desirable resilience. In other embodiments, 1,4-cis-polybutadiene may be used as the base rubber and mixed with other ingredients. In some embodiments, the amount of 1,4-cis-polybutadiene may be at least 50 parts by weight, based on 100 parts by weight of the rubber compound. Various additives may be added to the base rubber to form a compound. The additives may include a cross-linking agent and a filler. In some embodiments, the cross-linking agent may be zinc diacrylate, magnesium acrylate, zinc methacrylate, or magnesium methacrylate. In some embodiments, zinc diacrylate may provide advantageous resilience properties. The filler may be used to increase the specific gravity of the material. The filler may include zinc oxide, barium sulfate, calcium carbonate, or magnesium carbonate. In some embodiments, zinc oxide may be selected for its advantageous properties. Metal powder, such as tungsten, may alternatively be used as a filler to achieve a desired specific gravity. A person having ordinary skill in the art will be able to determine an appropriate specific gravity for the thermoset material for use in second layer 206 of ball 100. In some embodiments, the specific gravity of the thermoset material may be between about 1.10 g/mm$^2$ and about 1.14 g/mm$^2$. In some embodiments, the specific gravity may be about 1.12 g/mm$^2$.

The materials used to make the layers of ball 100 interrelate with each other to provide playing characteristics to the ball as a whole. The materials used to make ball 100 may differ in flexural modulus and hardness. Selecting materials within a specified range and with a specific relationship between the materials and layers may provide desirable results for a golfer. For many golfers, it is desirable that a ball have a good feel and spin control for short shots, while maintaining distance upon tee shots and long iron shots. The materials and properties may be selected to optimize these results. Using a material with a low flexural modulus for the outer cover can result in good feel for short shots or putting. Low flexural modulus materials for the outer cover may also result in good spin performance for short irons. Using a material with a relatively high flexural modulus for the inner cover layer can benefit long iron or driver shots by lowering the spin rate. Materials with a flexural modulus between those of the outer cover material and inner cover material may result in proper compression deformation for better feel. Therefore, the combination of all these flexural moduli can benefit a player for both long shots and short shots.

The thermoplastic materials used to make first layer 204, third layer 208, and fourth layer 210 have a specified relationship in terms of their respective flexural moduli. The flexural modulus of each thermoplastic material may be determined using the testing method described in ASTM D790. First thermoplastic material, used to form first layer 204, has a first flexural modulus. The first flexural modulus may be between about 5000 PSI and about 40000 PSI. Second thermoplastic material, used to form third layer 208, has a second flexural modulus. The second flexural modulus may be between about 20000 PSI and about 100000 PSI. Third thermoplastic material, used to form fourth layer 210, has a third flexural modulus. The third flexural modulus may be between about 1000 PSI and about 10000 PSI. While the ranges of these flexural moduli overlap, in some embodiments, it is desirable for the flexural moduli of the materials to have a specified relationship. In some embodiments, it is desirable for the second flexural modulus of the second thermoplastic material to be greater than the first flexural modulus of the first thermoplastic material. It may also be desirable for the first flexural modulus of the first thermoplastic material to be greater than the third flexural modulus of the third thermoplastic material. In some embodiments, it may be desirable for the second flexural modulus to be at least three times the first flexural modulus.

The various ball layers also have a hardness relationship. The hardness of each material may be measured on its curved surface (on the ball as opposed to on a plaque) using a standard testing protocol such as ASTM D2240. When hardness is referred to in this disclosure, such a testing protocol is understood to be used for that measurement. First layer 204 has a first hardness. Second layer 206 has a second hardness. Third layer 208 has a third hardness. Fourth layer 210 has a fourth hardness. In some embodiments, the third hardness is greater than the first hardness, the third hardness is greater than the second hardness, and the third hardness is greater than the fourth hardness. In some embodiments, the third hardness is at least 10 Shore D units harder than the fourth hardness. In some embodiments, the third hardness may be at least 60 Shore D. The use of a ball with inner cover layer 208 that is the hardest layer, particularly being at least 10 Shore D units higher than outer cover layer 210, may allow for greater spin control, while maintaining a soft feel of the ball.

Various layers of the ball may be characterized in terms of their respective coefficients of restitution (COR). In order to measure the COR of an object, the object is fired by an air cannon at an initial velocity of about 40 meters per second. The object can be a portion of a finished ball or the complete ball. A steel plate is positioned about 1.2 meters from the cannon, and a speed monitoring device is located at a distance of about 0.6 to about 0.9 meters from the cannon. The object is fired from the air cannon, and passes the speed monitoring device to determine an initial velocity. The object then strikes the steel plate and rebounds back past the speed monitoring device to determine the return velocity. The COR is the ratio of the return velocity over the initial velocity. In some embodiments, it may be desirable for first layer 204 to have a first COR between about 0.79 and 0.92. In some embodiments, it may be desirable for first COR to be about 0.808. Core 212 has a second COR. Ball 100 has a third COR. In some embodiments, it may be desirable for first COR to be higher than second COR. In some embodiments, it may be desirable for first COR to be higher than third COR. In some embodiments, it may be desirable for third COR to be about 0.77. In some embodiments, it may be desirable for first COR to be about 0.038 higher than third COR. By using such COR properties, it may be possible to optimize flight distance and feel of the ball.

Other properties may be desirable for ball 100. In some embodiments, it may be desirable for ball 100 to have a moment of inertia between about 80 g*cm$^2$ and about 90 g*cm$^2$. Such a moment of inertia may produce a desirable distance and trajectory, particularly when ball 100 is struck with a driver.

The compression deformation of first layer 204 may also be designed to fall in a desirable range. The compression deformation or deflection of core 212 may be measured in a standard test method. Specifically, core 212 may be subjected to an initial force of 10 kg to a final force of 130 kg. The difference between the deformation amount from the 130 kg force and the 10 kg force is considered the compression deformation. In some embodiments, it may be desirable for core 212 to have a compression deformation between about 2.2 mm and about 4.0 mm. When compression deformation is referred to in the preset disclosure, it is understood that such a testing protocol is used to determine that compression deformation.

In one exemplary embodiment, first layer 204 may have a first thickness or first diameter between about 19 mm and about 32 mm, and may in some embodiments have a diameter of about 24.5 mm. First layer 204 may have a first weight of about 8.30 g. First layer 204 may have a first compression deformation of about 3.68 mm. First layer 204 may have a first hardness of about 49 Shore D. Second layer 206 may have a second thickness between about 3.4 mm and about 9.90 mm, and may in some embodiments have a second thickness of about 7.05 mm. Second layer 206 may have a second weight of about 25.4 g. Second layer 206 may have a second hardness of about 58 Shore D. Core 212 may have a second compression deformation between about 2.2 and about 4.0 mm, and in some embodiments may have a second compression deformation of about 3.05 mm. Third layer 208 may have a third thickness between about 0.6 mm and about 1.2 mm and may in some embodiments have a third thickness of about 0.94 mm. Third layer 208 may have a third weight of about 5.2 g. Third layer 208 may have a third hardness of about 68 Shore D. Combined core 212 and third layer 208 may have a third compression deformation of about 2.75 mm. Fourth layer 210 may have a fourth thickness of about 1.10 mm, and in some embodiments may have a fourth thickness greater than the third thickness of than third layer 208. Fourth layer 210 may have a fourth weight of about 6.5 g. Fourth layer 210 may have a fourth hardness of about 51 Shore D. The combined thickness of third thickness and fourth thickness may be at least about 1.93 mm. Ball 100 may have a total diameter of at least 42.67 mm. Ball 100 may have a total weight of about 45.4 g. Ball 100 may have a total compression deformation of about 2.65 mm.

In another exemplary embodiment, first layer 204 may have a first thickness or diameter between about 24.40 mm and about 24.60 mm, and in some embodiments may have a thickness of about 24.55 mm. First layer 204 may have a first weight between about 8.15 g and about 8.45 g and in some embodiments may have a first weight of about 8.30 g. First layer may have a first hardness between about 49 Shore D and about 53 Shore D, and may in some embodiments have a first hardness of about 51 Shore D. In some embodiments, first layer 204 may be made of a blend of materials including one or more highly neutralized acid copolymers. Second layer 206 may have a second thickness between about 6.85 and about 7.15 mm, and may in some embodiments have a second thickness of about 7.00 mm. Second layer 206 may have a second weight between about 24.25 g and about 25.15 g and in some embodiments may have a second weight of about 24.7 g. Second layer 206 may have a second hardness between about 60 Shore D and about 64 Shore D, and may in some embodiments have a hardness of about 62 Shore D. In some embodiments, second layer 206 may be made from a compound including butadiene rubber. In some embodiments, core 212 may have an core compression deformation between about 3.60 mm and about 4.10 mm, and in some embodiments may have a compression deformation of about 3.85 mm. In some embodiments, an intermediate layer may be inserted between first layer 204 and second layer 206. In some embodiments, the intermediate layer may be made of a film made at least partially of ethylene vinyl acetate. The intermediate layer may have an intermediate layer thickness between about 0.01 mm and about 0.05 mm, and may in some embodiments have an intermediate layer thickness of about 0.03 mm. The intermediate layer may have an intermediate layer weight between about 0.1 g. Third layer 208 may have a third thickness between about 0.80 mm and about 1.1 mm, and may in some embodiments have a third thickness of about 0.95 mm. Third layer 208 may have a third weight between about 5.0 g and about 6.2 g, and may in some embodiments have a third weight of about 5.6 g. Third layer 208 may have a third hardness between about 65 Shore D and about 69 Shore D. Third layer 208 may be made partially or completely from a polyurethane resin. Fourth layer 210 may have a fourth thickness between about 1.00 mm and about 1.20 mm, and may in some embodiments have a thickness of about 1.10 mm. Fourth layer 210 may have a fourth weight between about 6.0 g and about 7.4 g, and in some embodiments may have a thickness of about 6.7 g. Fourth layer 210 may have a fourth hardness between about 53 Shore D and about 57 Shore D, and may in some embodiments may have a fourth hardness of about 55 Shore D. Fourth layer 210 may be made partially or completely from a polyurethane resin. Ball 100 made with these layers may have a ball diameter between about 42.67 mm and about 42.90 mm, and may in some embodiments have a ball diameter of about 42.7 mm. Ball 100 may have a ball weight between about 45.0 g and about 45.8 g and may in some embodiments have a ball weight of about 45.4 g. Ball 100 may have a ball compression deformation between about 2.25 mm and about 2.75 mm, and may in some embodiments have a ball compression deformation of about 2.50 mm. Ball 100 may have a ball COR between about 0.778 and about 0.788, and may in some embodiments have a COR of about 0.783.

A golf ball made according to the embodiments described herein, with the various layers having the hardness, flexural modulus, COR, and compression characteristics described above, is believed to have improved feel and play characteristics. When hit with a driver, the COR of the core tends to control the performance, and a golfer may experience a long, accurate drive. When hit with a short iron or wedge, the hardness of the cover tends to control feel and performance, and a golfer may experience improved feel and increased spinnability due to the relatively soft outer cover and relatively hard inner cover.

Alternate constructions of the layered article may also be possible to enhance these benefits. For example, a golf ball may be made according to the teaching of both this disclosure and the article described in U.S. Application Ser. No. 61/375,775, entitled "Golf Ball Having High Initial Velocity", and filed on even date herewith, which disclosure is incorporated herein by reference in its entirety.

While various embodiments of the invention have been described, the description is intended to be exemplary, rather than limiting and it will be apparent to those of ordinary skill in the art that many more embodiments and implementations are possible that are within the scope of the disclosure. Accordingly, the disclosure is not to be restricted except in light of the attached claims and their equivalents. Also, various modifications and changes may be made within the scope of the attached claims.

What is claimed is:

1. A ball, comprising:

a first layer, the first layer having a first flexural modulus;

a second layer, the second layer disposed radially outward of the first layer;

a third layer, the third layer disposed radially outward of the second layer, wherein the third layer has a second flexural modulus;

a fourth layer, the fourth layer disposed radially outward of the third layer, wherein the fourth layer has a third flexural modulus;

wherein the second flexural modulus is greater than the first flexural modulus and the first flexural modulus is greater than the third flexural modulus; and wherein the first layer has a first coefficient of restitution, the ball has a second coefficient of restitution, and the first coefficient of restitution is greater than the second coefficient of restitution;

wherein the first flexural modulus is between about 5000 PSI and about 40000 PSI, the second flexural modulus is between about 20000 PSI and about 100000 PSI, and the third flexural modulus is between about 1000 PSI and about 10000 PSI.

2. The ball according to claim 1, wherein the first layer comprises a first thermoplastic material, the third layer comprises a second thermoplastic material, and the fourth layer comprises a third thermoplastic material.

3. The ball according to claim 2, wherein the first thermoplastic material comprises at least one of an ionomer resin, a highly neutralized acid polymer composition, a polyamide resin, a polyester resin, a polyurethane resin, and a combination thereof;

the second thermoplastic material comprises at least one of an ionomer resin, a highly neutralized acid polymer composition, a polyamide resin, a polyester resin, a polyurethane resin, and a combination thereof; and the third thermoplastic material comprises at least one of an ionomer resin, a highly neutralized acid polymer composition, a polyamide resin, a polyester resin, a polyurethane resin, and a combination thereof.

4. The ball according to claim 3, wherein the second thermoplastic material is the same type of material as the third thermoplastic material.

5. The ball according to claim 1, wherein the second layer comprises a thermoset material.

6. The ball according to claim 1, wherein the second flexural modulus is at least three times the first flexural modulus.

7. The ball according to claim 1, further comprising a mantle layer between the first layer and the fourth layer.

8. A ball, comprising:

a first layer, the first layer having a first flexural modulus;

a second layer, the second layer disposed radially outward of the first layer;

a third layer, the third layer disposed radially outward of the second layer, wherein the third layer has a second flexural modulus;

a fourth layer, the fourth layer disposed radially outward of the third layer, wherein the fourth layer has a third flexural modulus;

wherein the second flexural modulus is greater than the first flexural modulus and the first flexural modulus is greater than the third flexural modulus; and wherein the first layer has a first coefficient of restitution, the ball has a second coefficient of restitution, and the first coefficient of restitution is greater than the second coefficient of restitution;

wherein the ball has a moment of inertia between about 80 $g*cm^2$ and about 90 $g*cm^2$.

9. The ball according to claim 8, wherein the first layer comprises a first thermoplastic material, the third layer comprises a second thermoplastic material, and the fourth layer comprises a third thermoplastic material.

10. The ball according to claim 9, wherein the first thermoplastic material comprises at least one of an ionomer resin, a highly neutralized acid polymer composition, a polyamide resin, a polyester resin, a polyurethane resin, and a combination thereof;

the second thermoplastic material comprises at least one of an ionomer resin, a highly neutralized acid polymer composition, a polyamide resin, a polyester resin, a polyurethane resin, and a combination thereof; and the third thermoplastic material comprises at least one of an ionomer resin, a highly neutralized acid polymer composition, a polyamide resin, a polyester resin, a polyurethane resin, and a combination thereof.

11. The ball according to claim 10, wherein the second thermoplastic material is the same type of material as the third thermoplastic material.

12. The ball according to claim 8, wherein the second layer comprises a thermoset material.

13. The ball according to claim 8, wherein the second flexural modulus is at least three times the first flexural modulus.

14. The ball according to claim 8, further comprising a mantle layer between the first layer and the fourth layer.

* * * * *